US009364963B2

(12) United States Patent
Alberto

(10) Patent No.: US 9,364,963 B2
(45) Date of Patent: Jun. 14, 2016

(54) CUTTER FOR PRINTED SUBSTRATES

(71) Applicant: FOTOBA INTERNATIONAL S.R.L., Quaregna BI (IT)

(72) Inventor: Pietro Alberto, Biella BI (IT)

(73) Assignee: FOTOBA INTERNATIONAL S.R.L., Quaregna (BI) (IT)

( * ) Notice: Subject to any disclaimer, the term of this patent is extended or adjusted under 35 U.S.C. 154(b) by 26 days.

(21) Appl. No.: 14/397,266

(22) PCT Filed: Apr. 24, 2013

(86) PCT No.: PCT/IB2013/053239
§ 371 (c)(1),
(2) Date: Oct. 27, 2014

(87) PCT Pub. No.: WO2013/160849
PCT Pub. Date: Oct. 31, 2013

(65) Prior Publication Data

US 2015/0143968 A1 May 28, 2015

(30) Foreign Application Priority Data

Apr. 27, 2012 (IT) ..... MI2012A0704

(51) Int. Cl.
*B26D 1/20* (2006.01)
*B26D 5/30* (2006.01)
(Continued)

(52) U.S. Cl.
CPC *B26D 1/205* (2013.01); *B26D 5/32* (2013.01); *B26D 7/1818* (2013.01); *Y10T 83/533* (2015.04); *Y10T 83/7688* (2015.04); *Y10T 83/773* (2015.04)

(58) Field of Classification Search
CPC ..... B21D 1/205; B26D 7/1818; B26D 5/32; B26D 1/185; B26D 5/20; B26D 7/2635; B26D 1/205; Y10T 83/773; Y10T 83/7688; Y10T 83/533; Y10T 83/6588; B41J 11/663; B31B 2201/146
USPC ..... 83/365, 425.3, 436.75, 508.3, 298, 407, 83/425–425.4, 436.7, 49.5, 498
See application file for complete search history.

(56) References Cited

U.S. PATENT DOCUMENTS 2,615,376 A * 10/1952 Pelikan ..... B26D 7/1818 493/373
4,611,517 A * 9/1986 Schmale ..... D06H 7/045 83/102.1
5,090,281 A * 2/1992 Paulson ..... B24B 3/368 83/13

(Continued)

OTHER PUBLICATIONS

International Search Report issued in PCT Application No. PCT/IB2013/053239.

(Continued)

*Primary Examiner* — Ghassem Alie
(74) *Attorney, Agent, or Firm* — Lucas & Mercanti, LLP.

(57) ABSTRACT

A cutter for printed substrates includes a supporting plane adapted to receive a substrate on which images separated by mutually perpendicular edges are printed, and a plurality of cutting units suitable for cutting the printed substrate along the edges. Each cutting unit has a pair of parallel blades spaced apart at a distance corresponding to a width of the edges, a backing plane arranged underneath the supporting plane of the cutter, and a connecting arm which extends from a frame of the cutting unit to the backing plane. The connecting arm is parallel to the blades and is arranged between them and a through opening is formed in a portion of the backing plane under the connecting arm.

9 Claims, 3 Drawing Sheets

(51) Int. Cl.
*B26D 5/32* (2006.01)
*B26D 7/18* (2006.01)

(56) References Cited

U.S. PATENT DOCUMENTS 5,907,984 A 6/1999 Herman, Jr. et al.
8,701,535 B2 * 4/2014 Endo ..... B26D 1/245 83/425.2
2004/0149105 A1 * 8/2004 Michalski ..... B26D 7/20 83/495
2011/0283855 A1 * 11/2011 Kwarta ..... B26D 1/185 83/425.4
2015/0343660 A1 * 12/2015 Pappas ..... B26D 5/06 83/508.2

OTHER PUBLICATIONS

Written Opinion of International Searching Authority issued in counterpart PCT Application No. PCT/IB2013/053239.

* cited by examiner

CUTTER FOR PRINTED SUBSTRATES

CROSS-REFERENCE TO RELATED APPLICATIONS

This application is a 371 of PCT/IB2013/053239, filed Apr. 24, 2013, which claims the benefit of Italian Patent Application No. MI2012A000704, filed Apr. 27, 2012, the contents of each of which are incorporated herein by reference.

FIELD OF THE INVENTION

The present invention relates generally to cutting of substrates printed by way of printing machines, such as advertising panels printed by digital printing machines, and in particular to a cutter for cutting printed substrates of a rigid type such as e.g. cardboard panels, PVC foam plates or multilayer flat products.

BACKGROUND OF THE INVENTION

Known cutters for printed substrates generally comprise a supporting plane adapted to receive a printed substrate, as well as a plurality of cutting units comprising a blade having a substantially circular shape rotatably mounted about an axis parallel to the supporting plane. The cutting units are generally mounted on a cutter so as to make cuts along mutual orthogonal directions, in particular along a longitudinal direction parallel to a feeding direction of a substrate, and along a transverse direction perpendicular thereto.

The cutters also generally comprise cylinders suitable to drag the printed substrate along the supporting plane, so that the cuts needed to separate individual images printed on the substrate are obtained by way of relative movements between the substrate and the blades of the cutting units. In order to make cuts along the longitudinal direction, one or more longitudinal cutting units are used the blades of which are aligned along the feeding direction of the substrate. These cutting units are generally slidably restrained to a crosspiece of the cutter along suitable rails that allow adjustment of their relative positions, as well as their locking on the crosspiece. In order to make cuts along the transverse direction at least one transverse cutting unit is generally provided, the blade of which is aligned along the transverse direction. This cutting unit is transversely movable between the ends of the cutter by way of a suitable motorized slider.

In digital printing processes of substrates made of a rigid material, printed images are separated from each other by edges suitable to allow the cutting units described above to cut them. The edges are generally identified by special cutting marks, such as e.g. bar codes, that are automatically detectable via sensors, its particular optical sensors, which allow automatic cutting of printed substrates.

Since the width of the edges has a non-negligible size, the cutting operations necessary to cut the images printed from a substrate require to carry out for each edge a first and a second cut spaced according to the size of the edge to eliminate. In order to make a cut e.g. along the transverse direction, when the sensors detect a cutting mark the cutter cylinders are stopped, thus blocking the printed substrate for the execution of a first transverse cut. Subsequently, the cylinders cause the printed substrate to advance along a path the length of which corresponds to the width of the edge, then are stopped again to allow the execution of a second transverse cut.

This sequence of movements and stops of printed substrates results in cutting operations that are considered quite long by the those skilled in the art.

Another problem related to the execution of cuts in printed substrates is that after a cutting operation the edges separated from the images constitute scraps which move together with them and must be removed manually by an operator at the exit from the cutter, which is a time consuming operation.

SUMMARY OF THE INVENTION

There is therefore the need to reduce the time required for the cutting of printed substrates in order to increase the productivity of cutters, which is an object of the present invention.

It is also an object of the present invention to eliminate cut edges or substrate scraps during cutting operations without manual intervention of an operator.

An idea of solution underlying the present invention is to make a cutter wherein the individual cutting units include a pair of parallel blades mutually spaced at a distance corresponding to the size of the edges present between images printed on a substrate.

It is also an idea of solution underlying the invention to provide a cutter comprising a system for the removal of substrate scraps during cutting operations without the need for manual intervention by an operator. To this aim, the double blade cutting units comprise an backing plane of the blades, which is arranged underneath the supporting plane of the cutter, and a connecting arm which extends diagonally from a frame on which the blades are mounted to the backing plane in a direction opposite to the cutting direction. The connecting arm is arranged between the blades and symmetrically relative thereto and a through opening is formed in the portion of the backing plane comprised between the area intended to contact the blades and the attachment point of the connecting arm. Therefore, the substrate is cut between the blades and the backing plane of the cutting unit and during a cutting operation the relative movement between the printed substrate and the cutting units causes substrate scraps to come into contact with the connecting arm, thereby being deflected diagonally towards the backing plane and then under the supporting surface of the cutter via the through opening formed in the backing plane.

Thanks to this configuration, the edges present between the images printed on the substrate can be cut in a single step by the cutting units and substrate scraps can be separated directly daring cutting operations without the need for manual intervention of an operator, as well as collected in one or more suitable containers arranged under the cutter.

The main advantage offered by the invention is therefore a remarkable reduction of the time needed to perform cutting operations, which considerably increases the productivity of a cutter.

The cutting units intended to perform cuts along the longitudinal direction are preferably arranged at an outlet end of the supporting plane of the cutter, thus allowing removal of substrate scraps without requiring modifications of the supporting plane. The cutting units intended to perform cuts along the transverse direction are preferably arranged at an intermediate position of the supporting plane relative to the feeding direction of the substrate, whereby the supporting plane comprises in such a position respective transverse apertures suitable to allow falling of substrate scraps thereunder.

In order to increase cutting efficiency, the cutting units may advantageously comprise a pair of grooves formed in the backing plane of the blades. In this way, printed substrates to be out are completely crossed by the blades in the direction of their thickness. The grooves serve as guides for the blades, which guides are tailored to ensure the execution of straight cuts.

BRIEF DESCRIPTION OF THE DRAWINGS

Further advantages and features of the cutter according to the present invention will become clear to those skilled in the art from the following detailed and non-limiting description of an embodiment thereof with reference to the attached drawings in which.

DETAILED DESCRIPTION OF THE INVENTION

Figure 1:
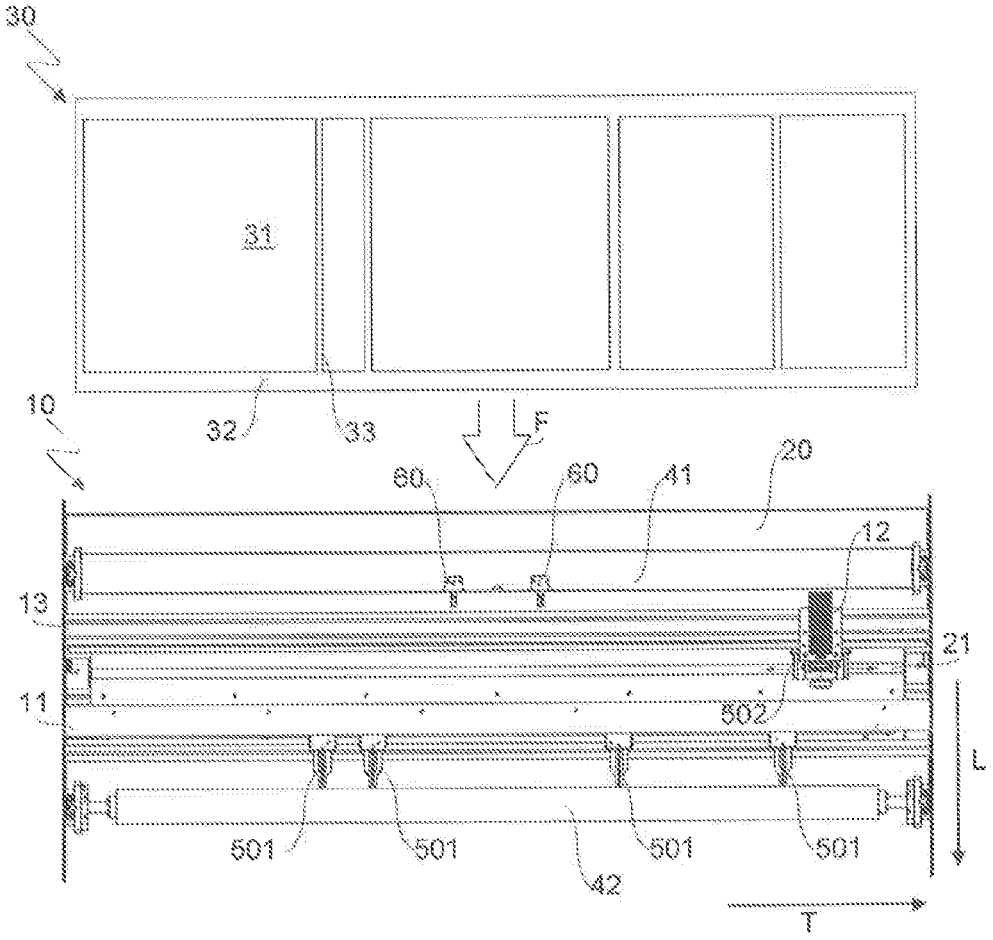
FIG. 1 is a top view schematically showing a cutter according to the present invention.

Referring to FIG. 1, the cutter 10 according to the invention comprises a supporting plane 20 adapted to receive a printed substrate 30 comprising a plurality of images 31 separated by a plurality of edges 32, 33 that are mutually perpendicular. The cutter 10 also comprises at least one inlet roller 41 and at least one outlet roller 42 suitable to drag the substrate 30 therethrough in a feeding direction indicated in the figure by an arrow F.

The cutter 10 is provided with a plurality of cutting units 501, 502 arranged so as to cut the printed substrate 30 along the edges 32, 33 in two directions that are mutually perpendicular, in particular a longitudinal direction L, parallel to the feeding direction F, and a transverse T, perpendicular to the feeding direction F.

The cutter 10 comprises at least one longitudinal cutting unit 501 adapted to perform cuts of the substrate 30 along the longitudinal direction L and at least one transverse cutting unit 502 adapted to perform cuts of the substrate 30 along the transverse direction T. The longitudinal and transverse cutting units 501, 502 have the same structure, the only difference being their orientation with respect to the cutter 10 in order to allow cuts of the substrate 30 along perpendicular directions.

In the illustrated embodiment, the cutter 10 comprises four longitudinal cutting units 501 and a single transverse cutting unit 502.

The longitudinal cutting units 501 are slidably restrained to a crosspiece 11 of the cutter 10 along suitable rails (not shown) which allow adjustment of their relative position and their locking thereto e.g. by way of clamps.

The transverse cutting unit 502 is instead restrained to a motorized slider 12 of the cutter 10 movable in the transverse direction T between its ends along a crosspiece 13.

According to the present invention, the cutting units are each provided with a pair of blades 51 parallel and mutually spaced at a distance corresponding to the width of the edges 32, 33 separating the images 31 printed on the substrate 30, for example through a spacer 52, thus allowing to separate these edges 32, 33 from the images 31 in a single step and to achieve a high cutting speed. In particular, the time a cutting operation takes is more than halved with respect to the cutting time of a traditional cutter, because, unlike known cutters a first and a second cut for the removal of the edges 32, 33 are no longer required and it is no longer necessary to move and stop the substrate between subsequent cuts for this purpose.

The cutter 10 further comprises a system suitable to allow removal of substrate scraps, i.e. the edges 32, 33 cut by the blades 51, during cutting operation without the need for manual intervention by an operator.

Figure 2:
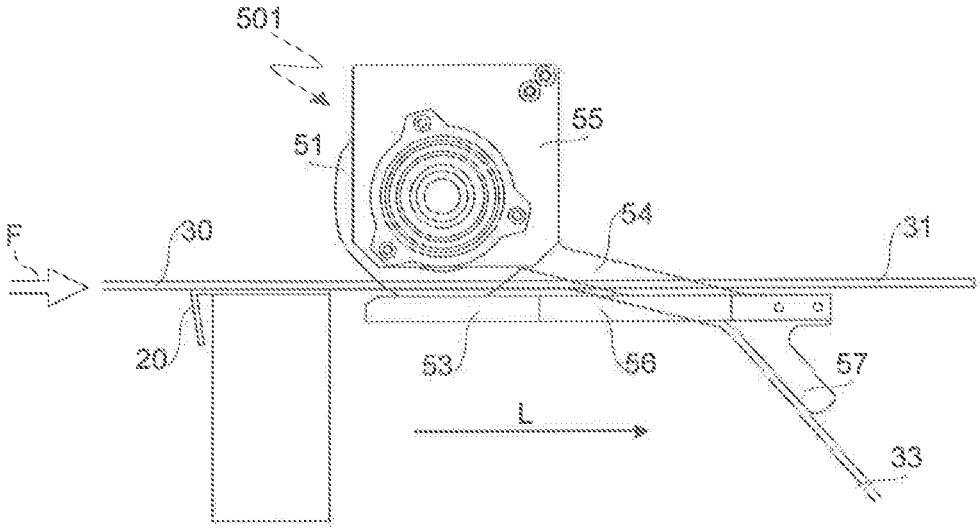
FIG. 2 is a side view schematically showing a longitudinal cutting unit of the cutter according to the invention.
Figure 3:
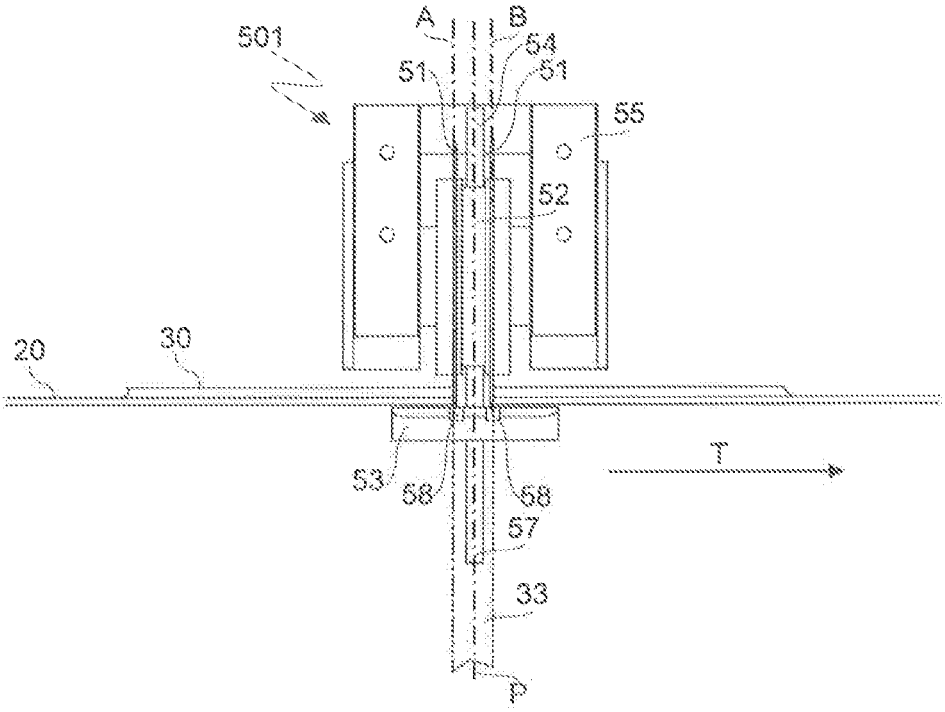
FIG. 3 is a front view schematically showing a longitudinal cutting unit of the cutter according to the invention.
Figure 4:
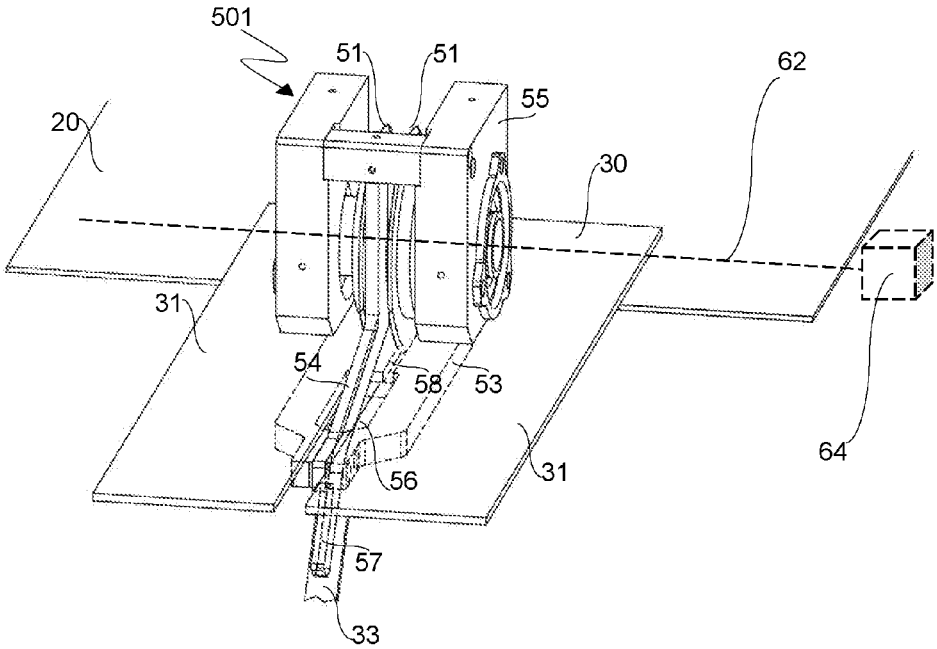
FIG. 4 is a perspective view of the longitudinal cutting unit shown in FIGS. 2 and 3.

With particular reference to FIGS. 2 to 4, which show a longitudinal cutting unit 501, each cutting unit comprises a backing plane 53 arranged underneath the supporting plane 20 of the cutter 10, i.e. between the latter and the ground, suitable to provide a backing surface to the blades 51 during cutting, and a connecting arm 54 which extends e.g. diagonally from a frame 55, on which the blades 51 are mounted, to the backing plane 53 in a direction opposite to the cutting direction.

The connecting arm 54 is parallel to the blades 51 and is arranged on a plane P parallel to the planes A, B on which the blades 51 lie.

The plane P is preferably arranged in a symmetrical position with respect to the planes A and B, i.e. symmetrically between the blades 51.

A through opening 56 is formed in the portion of the backing plane 53 comprised between the area arranged underneath the blades 51 and the area wherein the connecting arm 54 is fixed, whereby due to the relative movement between the printed substrate 30 and the cutting units in the cutting direction, an edge or substrate scrap cut by the blades 51, e.g. a longitudinal edge 33, comes in contact with the connecting arm 54 and is thereby deflected diagonally towards the backing plane 53 crossing the through opening 56 and falling under the supporting plane 20 of the cutter 10, where it can e.g. be collected into a container (not shown).

The longitudinal cutting units 501 are preferably arranged at an outlet end of the supporting plane 20, whereby substrate scraps fall below it at the outlet end of the supporting plane 20 of the cutter 10.

The transverse cutting unit 502 is instead preferably arranged at an intermediate position of the supporting plane 20 with respect to the feeding direction F. For this purpose the supporting plane 20 includes in this position a transverse aperture 21 adapted to allow removal of substrate scraps generated by transverse cuts.

It will be understood that this configuration of the cutter 10 is not essential in the invention, being it also possible to arrange the transverse cutting unit 502 at the outlet end of the supporting plane 20 and the longitudinal cutting unit 501 arranged at an intermediate position in correspondence to the transverse aperture 21. However, this configuration is preferred, because it allows a better access to the longitudinal cutting unit or units 501, facilitating their assembling and position adjustment along the rails of the crosspiece 11.

It will be also understood that the provision of the transverse aperture 21 in the supporting plane 20 is not essential in the invention. The supporting plane 20 in fact may as well be divided into two parts whose facing ends are arranged in correspondence with the cutting path of the transverse cutting unit 502 and suitably spaced apart to define an opening allowing passage of substrate scrap under the supporting plane of the cutter 10.

According to a former aspect of the invention, in order to facilitate falling of substrate scraps under the supporting plane 20, the connecting arm 54 may advantageously comprise a tail portion 57 which extends below the backing plane 53 from the fixing point of the connecting arm 54, thus forming an extension thereof.

As shown in FIG. 2, the tail portion 57 may advantageously be inclined relative to the connecting arm 54, preferably forming an obtuse angle therewith whose concavity faces the space under the supporting plane 20, thus allowing to divert substrate scraps generated by the cuts most vertically.

As shown in FIG. 3, in order to increase cutting effectiveness of the blades 51, the backing plane 53 may advantageously comprise a pair of parallel grooves 58 which extend in the longitudinal direction L and are spaced in the transverse direction T at a distance corresponding to the distance between the blades 51. The printed substrate 30 to be cut is thus completely crossed by the blades 51 in the direction of its thickness, the grooves 58 serving as guides for the blades 51 adapted to prevent their deformation and therefore as means contributing to maintain the cutting paths straight.

Still in the aim to increase the cutting effectiveness, the blades 51 are preferably keyed on a same blade shaft 62 driven into rotation by a motor 64 of the cutter 10, as shown schematically in FIG. 4. Cutting is therefore performed not simply by way of a relative movement between the printed substrate 30 and the cutting units 50, but also by means of the rotation imparted by the motor 64 to the blades 51, which allows to cut a wide range of materials from the softer ones, such as paperboard, to the harder ones, such as multi-layer products.

The alignment between the cutting units and the edges 32, 33 present between the images 31 printed on the supports 30 may be performed manually, but is preferably carried out automatically by using cutting marks such as e.g. bar codes that are typically printed along the edges 32, 33.

For this purpose, the cutter 10 may include a plurality of optical sensors suitable for detecting the cutting marks indicative of the position of the edges 32, 33 and configured to allow automatic alignment between the cutting units and the edges 32, 33 through an appropriate control program. In the embodiment shown in FIG. 1 two optical sensors 60 are e.g. shown, the optical sensors being adapted to detect the edges 32 intended to be cut by the transverse cutting unit 502. The cutter 10 also includes further optical sensors (not shown) associated with the crosspiece 11 and adapted to locate the edges 33 intended to be cut by the longitudinal cutting units 501.

The embodiment of the invention herein described and illustrated is just an example susceptible of numerous variants. For example, the cutter may comprise more than one transverse cutting unit 502 and correspondingly more than one transverse openings to allow discharge of substrate scraps generated by transverse cuts. Moreover, in order to adapt the cutting units to various types of printed substrates, the distance between their blades 51 and the respective backing planes 53 may be adjustable, for example by way of screw registers or slots e.g. arranged where the connecting arm 54 is fixed to the backing plane 53.

The invention claimed is:

1. A cutter for cutting printed substrates, said cutter comprising a supporting plane suitable to receive along a feeding direction (F) a printed substrate comprising a plurality of images separated by a plurality of edges that are perpendicular to each other, and a plurality of cutting units suitable to cut said printed substrate along said edges in a longitudinal direction, parallel to said feeding direction (F), and in a transverse direction (T), perpendicular to said feeding direction (F), characterized in that each cutting unit comprises a pair of blades parallel to each other and mutually spaced at a distance corresponding to a width of the edges, a backing plane, arranged underneath the supporting plane of the cutter and suitable to provide a backing surface to said blades during a cutting operation, and a connecting arm extending from a frame of the cutting unit, on which the blades are mounted, to said backing plane in a direction opposite to the cutting direction, and in that said connecting arm is parallel to the blades and lies on a plane (P) parallel to the planes (A, B) on which the blades lie, and a through opening is formed in a portion of the backing plane arranged under the connecting arm.

2. A cutter according to claim 1, wherein the plane (P) on which the connecting arm lies is in a symmetrical position with respect to the planes (A, B) on which the blades lie.

3. A cutter according to claim 1, wherein the connecting arm comprises a tail portion extending below the backing plane of the cutting unit from the area wherein the connecting arm is fixed, said tail portion forming an extension of the connecting arm.

4. A cutter according to claim 3, wherein said tail portion is inclined relative to the connecting arm and forms an obtuse angle therewith, the concavity of which faces the space under the supporting plane.

5. A cutter according to claim 1, wherein the backing plane comprises a pair of parallel grooves extending in the longitudinal direction (L) and spaced at a distance in the transverse direction (T) corresponding to the distance between the blades.

6. A cutter according to claim 1, wherein the blades are fitted on a same shaft that is drivable into rotation by way of a motor of the cutter.

7. A cutter according to claim 1, comprising at least one longitudinal cutting unit and at least one transverse cutting unit.

8. A cutter according to claim 7, wherein, referring to the feeding direction (F), said at least one longitudinal cutting unit is arranged at an outlet end of the supporting plane and said at least one transverse cutting unit is arranged at an intermediate position of the supporting plane, the supporting plane comprising a transverse aperture extending along the cutting path of the transverse cutting unit.

9. A cutter according to claim 1, further comprising a plurality of optical sensors suitable to detect a plurality of cutting marks indicative of the position of the edges of the images printed on the substrate and configured so as to allow automatic alignment between the cutting units and the edges.

* * * * *